United States Patent [19]

Winkler et al.

[11] Patent Number: 4,762,480

[45] Date of Patent: Aug. 9, 1988

[54] ROTARY PUMP

[75] Inventors: Otmar Winkler, Schweinfurt; Heinz Peter; Egon Pfaller, both of Dittelbrunn, all of Fed. Rep. of Germany

[73] Assignee: SKF GmbH, Schweinfurt, Fed. Rep. of Germany

[21] Appl. No.: 22,988

[22] Filed: Mar. 6, 1987

Related U.S. Application Data

[63] Continuation of Ser. No. 775,421, Sep. 12, 1985, abandoned.

[30] Foreign Application Priority Data

Sep. 20, 1984 [DE] Fed. Rep. of Germany ..... 3434501

[51] Int. Cl.[4] ..... F04C 18/344

[52] U.S. Cl. ..... 418/266; 418/270

[58] Field of Search ..... 418/259, 266–270

[56] References Cited

U.S. PATENT DOCUMENTS

| | | | |
|---|---|---|---|
| 154,532 | 8/1874 | Tuerk | 418/268 |
| 156,814 | 11/1874 | Peck | 418/268 |
| 1,009,362 | 11/1911 | Wester | 418/266 |
| 2,312,886 | 3/1943 | Ellinwood | 418/266 |
| 2,321,190 | 6/1943 | Ellinwood | 418/266 |
| 2,521,592 | 9/1950 | McManus | 418/266 |
| 2,688,287 | 9/1954 | Burrows | 418/267 |
| 2,752,893 | 7/1956 | Oleskow | 418/266 |
| 3,120,154 | 2/1964 | Gilreath | 418/268 |
| 4,519,755 | 5/1985 | Hanson | 418/171 |

FOREIGN PATENT DOCUMENTS

| | | | |
|---|---|---|---|
| 2074246 | 10/1981 | United Kingdom | 418/267 |

*Primary Examiner*—Carlton R. Croyle
*Assistant Examiner*—Jane E. Obee
*Attorney, Agent, or Firm*—Eugene R. Renz, Jr.

[57] ABSTRACT

Rotary pump comprising a housing having a bore and a first adjacent lateral side wall having at least one inlet slit and a second adjacent lateral side wall having at least one outlet slit of at least equal size to said inlet slit for flow of medium axially therethrough, said slits in said lateral side walls defining the path of flow for said medium from said inlet axially directly into said bore and then from said bore axially directly to said outlet slit, a rotor mounted in the bore for rotation about an axis generally parallel to and eccentric to the bore axis, a plurality of vanes pivotally mounted on the periphery of the rotor having free ends in sliding sealing contact with said bore, each vane having lateral surfaces having an inner edge facing the rotor and an outer edge facing the bore which edges on rotation of the rotor pass over an inner boundary edge of the inlet and outlet slits facing the bore of the housing, said inlet slit and outlet slit, curving along an arc around the rotational axis of rotor and extending in such a way that the trailing end of the inlet slit and the leading end of the inlet slit are disposed adjacent a central plane passing through the axis of the bore of the housing and the rotational axis of the rotor.

6 Claims, 3 Drawing Sheets

ROTARY PUMP

This is a continuation of application Ser. No. 775,421 filed Sept. 12, 1985, entitled ROTARY PUMP, now abandoned.

FIELD OF THE INVENTION

The present invention relates to rotary pumps of the type comprising a rotatable rotor eccentrically mounted in the bore of a housing having a plurality of pivotally mounted vanes attached to the outer periphery of the rotor. More specifically, the invention relates to improvements in rotors of this type characterized by novel features of construction and arrangement providing a high degree of efficiency which is of compact design and relatively economical to manufacture.

BACKGROUND OF THE INVENTION

Rotary pumps of the general type described above are not new per se. For example, there is shown in West German Offenlegungsschift No. 3,014,520, a rotary pump having an inlet slit as viewed in the direction of rotation which extends radially outwardly in relation to the rotational axis of the rotor so that the end on the slit pointing away against the direction of rotation is oriented at an acute angle to the cylindrical side surface of the rotor adjacent the lateral surface. In this pump, the radially outwardly pivoting vanes pass over the inlet slit at a relatively late point, that is to say at a relatively large vane distance from the central plane passing through the rotational axis of the rotor and the axis of the housing bore. Consequently, as a result of a suction effect, restoring moments in the working chamber forming the vanes but not yet connected to the inlet slit act on the rotor. It has been found that under certain conditions, these moments drastically impair the efficiency of the pump.

SUMMARY OF THE INVENTION

With the foregoing in mind, it is an object of the present invention to provide a rotary pump characterized by novel features of construction and arrangement which eliminates the drawbacks of prior pumps and is characterized by an especially high degree of efficiency and additionally is of compact design which is easy and economical to manufacture. To this end, in a rotary pump in accordance with the present invention, the radially outwardly pivoting vane approaching from its change point on the central plane reaches the inlet slit of the side wall of the housing at a relatively early point. To this end, the housing is provided with inlet and outlet slits which are curved along an arc around the rotational axis of the rotor extending in a predetermined manner so that the end of the inlet slits facing against the direction of the rotation of the rotor and the end of the outlet slits pointing in the rotational direction are closely adjacent a central plane passing through the axis of the bore of the housing and the rotational axis of the rotor. By reason of this configuration, the radially outwardly pivoting vanes approaching from a change point on the central plane reach the inlet slit in the housing at a relatively early point. Thus, the working chamber which is increasing in size, for example, from zero between two adjacent vanes is quickly connected to the inlet slit. A consequence of this is that the rotary pump is, therefore, highly efficient. Furthermore, it has been observed that the inlet and outlet slits of the rotary pump extending in a curve around the rotation of the axis of the rotor can be formed by machining in the side wall of the housing very easily and with great accuracy. Additionally by reason of this construction, the rotary pump takes up a relatively small amount of space in the radial direction and can, therefore, be made compactly which is advantageous.

There are other features of the present invention providing certain functional advantages. For example, the inner and outer edges of the lateral surfaces of the vanes and the inner and outer boundary edges of each inlet and outlet slit are preferably generally parallel to one another. By this configuration, this arrangement simplifies the production of the vanes and also provides relatively large working chambers between adjacent vanes.

In accordance with another feature of the invention, the inlet slits are disposed at a greater distance from the rotational axis of the rotor than the outlet slits. Thus, the end of the inlet slit facing against the direction of rotation and the end of the outlet slit facing in the same direction are in optimum proximity to the central plane of the rotary pump. The inlet slit connects the working chamber just then starting to increase in size between the vanes at a relatively early point. Simultaneously the outlet slit connects the working chamber of the vanes adjacent the central plane which chamber is decreasing in size to, for example zero, for a relatively long time.

BRIEF DESCRIPTION OF THE DRAWINGS

These and other objects of the present invention and the various features and details of the operation and construction thereof are hereinafter more fully set forth with reference to the accompanying drawings wherein.

DESCRIPTION OF THE PREFERRED EMBODIMENT

Figure 1:
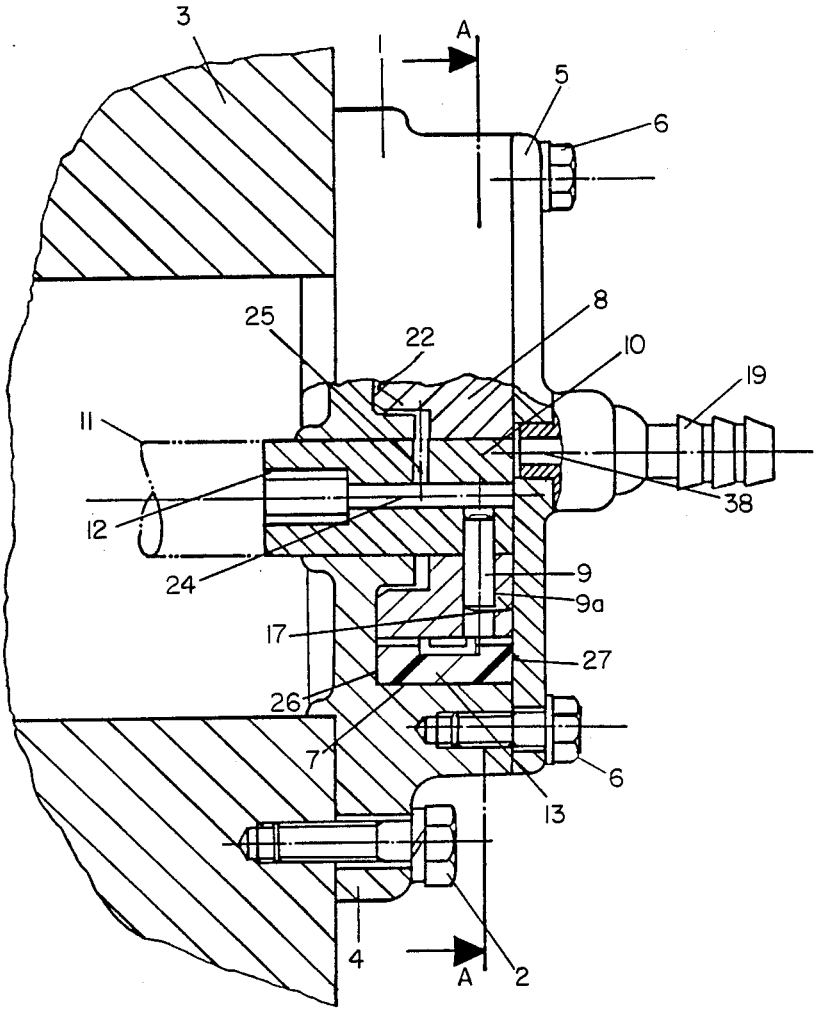
FIG. 1 is a fragmentary longitudinal sectional view through a rotary pump in accordance with the present invention.
Figure 2:
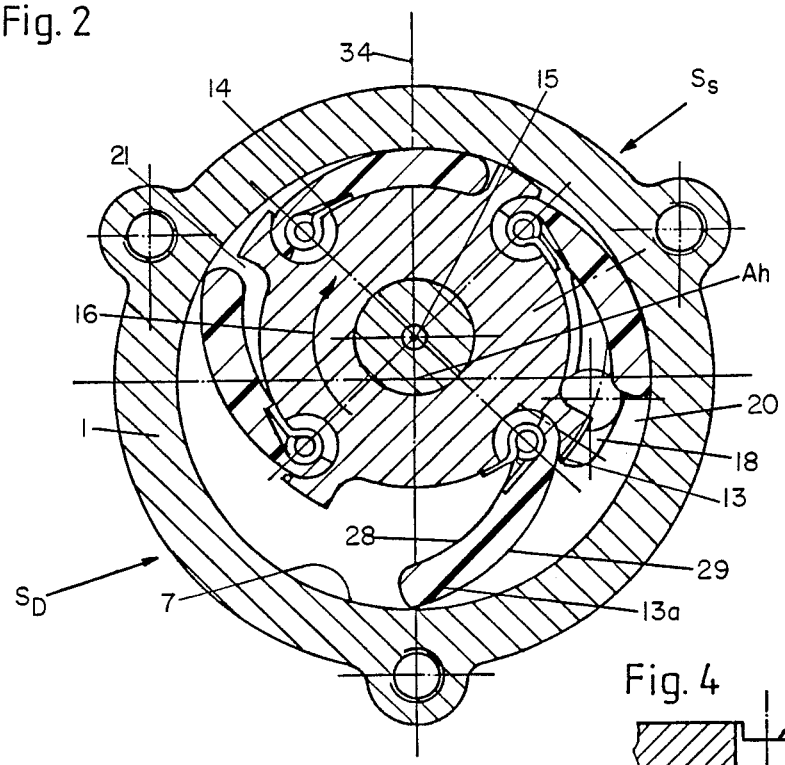
FIG. 2 is an enlarged cross-sectional view taken on lines A—A of FIG. 1.

Referring now to the drawings, and particularly to FIGS. 1 and 2 thereof, there is illustrated a rotary pump for producing a vacuum constructed in accordance with the present invention. The pump may serve as a vacuum braking force amplifier in a motor vehicle. To this end, the pump includes a housing 1 attached by flanges to the engine block 3 of an internal combustion engine (not shown) by means of screw fasteners 2. Housing 1 consists of a bell section 4 and a cover section 5 which, in turn, is secured firmly to the outer end surface of the bell section 4 by means of screw fasteners 6.

A rotor 8 is rotatably supported in the bore 7 of the housing and as illustrated is non-rotatably connected to a central shaft member 10 by means of a pin engaging through a radial bore 9*a*. A drive shaft 11 (shown in broken lines in FIG. 1) engages in a polygonal recess 12 in shaft member 10 in a form locking manner. By this arrangement, rotor 8 is supported in housing 1 and driven by the drive shaft 11.

Figure 3:
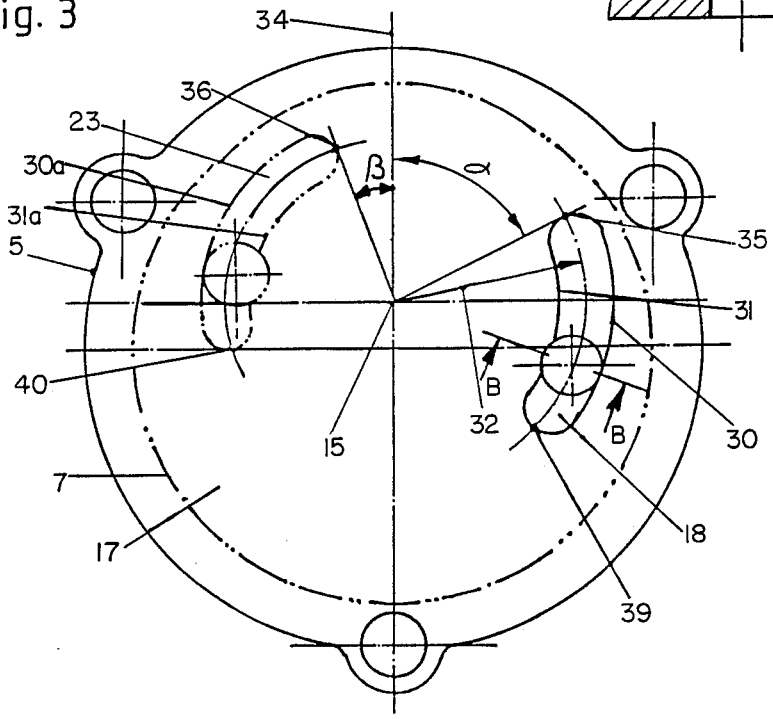
FIG. 3 is a top plan view showing the inner side wall of the cover part of the housing illustrated in FIGS. 1 and 2 in the disassembled state.
Figure 5:
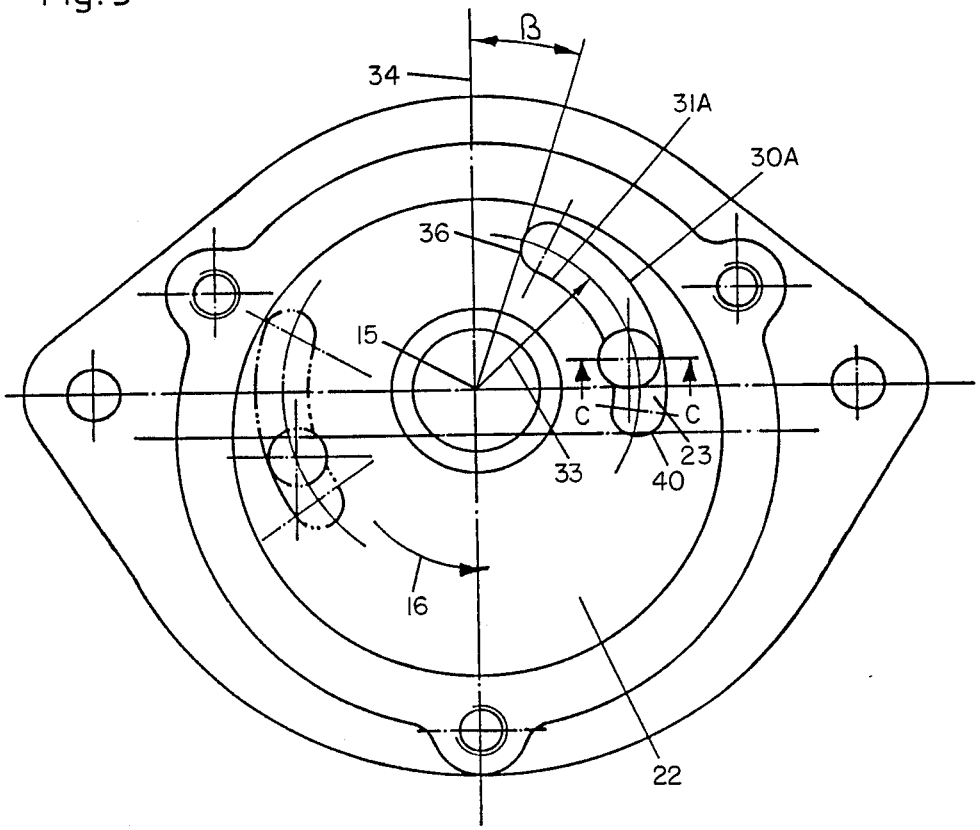
FIG. 5 is a top plan view on the inner side wall of the bell part of the housing in the disassembled state.

Four vanes 13 preferably made of a sliding, friction-resistant material are pivotally mounted at circumferentially-spaced locations around the periphery of the rotor 8. The free ends 13*a* of the vanes 13 slide tightly in bore 7 of bell section 4 of housing 1, each vane having a wire spring 14 which presses them radially outwardly against bore 7. As illustrated in FIG. 2, the rotational axis 15 of rotor 8 is generally parallel and eccentric to the axis $A_h$ of bore 7. Referring now to FIGS. 2, 3 and 5 which show the central plane 34 passing through the axis of bore 7 of housing 1 and the rotational axis 15 of rotor 8, the right side of central plane 34 is the suction side $S_s$ (FIGS. 2 and 3) and the left side is the delivery side $S_d$ of the rotary pump.

Considering now operation of the rotary pump, when rotor 8 turns in the direction of arrow 16 around its rotational axis 15 (FIG. 2), air is drawn in through an inlet slit 18 machines into a side wall 17 of cover section 5. As best illustrated in FIG. 1, inlet slit 18 is connected to a suction valve 19 in turn mounted on cover section 5. Air drawn in passes into working chamber 20 which as rotor turns increasing in size (working chamber 20 formed between two adjacent vanes 13*a*, 13*b*) on the intake side of rotary pump.

On the delivery side $S_d$ of the rotary pump, a working chamber 21 through an outlet slit 23 formed, for example, by machining in the side wall 22 of the bell section 4. During operation, the sliding surfaces of rotor 8 and vanes 13 are lubricated by a central oil feed port 24 having a radial connecting channel 25 in shaft member 10. As best illustrated in FIG. 1, side wall 17 and cover section 5 and side wall 22 of bell section 4 join laterally with bore 7 of housing 1. The two lateral sides surfaces 26, 27 of each vane 13 slide tightly in confronting side walls 17 and 22. Each side surface 26, 27 has an inner edge 28 which faces rotor 8 and curves in the direction of the rotational axis 15 in the outer edge 29 which faces bore 7 of bell section 4 and which also curves in the direction of rotational axis 15. Thus, when rotor 8 turns around its rotational axis 15, these edges 28, 29 pass over an outer boundary ede 30, 30*a* of the inlet and outlet slits 18, 23 facing bore 7 of housing 1 and an inner boundary edge 31 or 31*a* of the slits facing rotor 8.

Inlet slit 18 and outlet slit 23, extend in an arcuate manner along a circular arc around the rotational axis 15 of rotor 8. See, for example, radius 32 of circular arc of inlet 18 in FIG. 3 and radius 33 of circular arc of outlet slit 23 in FIG. 5. Inlet slit 18 is preferably at a greater distance, that is of a larger radius 32 as measured from the rotational axis 15 than the outlet slit 23. In a preferred arrangement, the distance of inlet slit 18 from rotational axis 15 is between 1.2 and 1.4 times the greatest distance times the radius 33, that is the distance of outlet slit 23 from the axis 15. The depth X of the bottom surface of inner and outlet slits 18, 23 is preferably at least 0.4 times as great as the distance between the inner and outer edges 28, 29 of the side surfaces 26, 27 of vane 13 opposite the slit.

FIGS. 2, 3 and 5 show the central plane 34 passing through the axis of bore 7 of housing 1 and the rotational axis 15 of rotor 8. The right side of central plane 34 shown in the drawings of FIGS. 2 and 3 is the suction side, and the left is the delivery side of the rotary cell pump.

The end 35 of inlet slit 18 faces against the direction of rotation 16 and is situated near the transition between the flat side wall 17 and bore 7 of housing 1.

The end 36 of the outlet slit 23 facing in the direction of rotation 16 is also near central plane 34, but it is at a greater distance from the transition between the side wall 17 and bore 7.

In the embodiment illustrated, both outer edge 29 and inner edge 28 of side surfaces 26, 27 of each vane 13 and outer boundary edge 30, 30*a* and inner boundary edge 31, 31*a* of inlet and outlet slits 18, 23 are parallel to each other.

Figure 4:
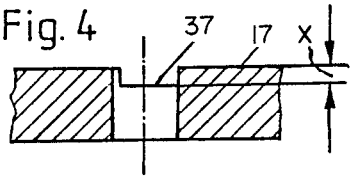
FIG. 4 is an enlarged sectional view taken along lines B—B of the cover part shown in FIG. 3.
Figure 6:
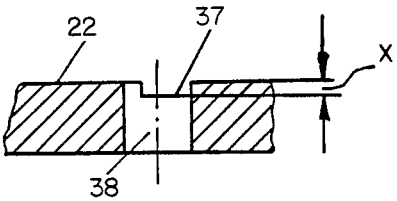
FIG. 6 is a sectional view taken along lines C—C through the bell part.

Inlet slit 18 and outlet slit 23 are provided with a bottom surface 37 forming the boundary of depth X of the slit (see FIGS. 4 and 6). A connecting channel 38 opens into this bottom surface 37; the channel is in side wall 17 of cover 5 or in side wall 22 of bell section 4. Depth X of bottom surface 37 of inlet and outlet slits 18, 23 is at least 0.4 times as large as the distance between the inner and outer edges 28, 29 of side surfaces 26, 27 of each vane 13 facing the slit.

The cross section of inlet and outlet slits 18, 23 is at least half as large as the circular cross section of connecting channel 38. The connecting channel of inlet slit 18 is formed in addition by the bore of suction valve 19.

The length of outlet slit 23 is preferably about 1.3–1.4 times as large as the length of inlet slit 18. End 35 of inlet slit 18 facing against the direction of rotation is preferably at an angle a=60° from central plane 34 in the rotational direction 16 of rotor 8. End 36 of outlet slit 23 facing in the direction of rotation 16 is preferably at an angle b=20° from central plane 34 against the direction of rotation 16.

Inlet slit 18 has an end 39 pointing in the direction of rotation 16, and outlet slit 23 has an end 40 pointing against the direction of rotation 16. These two ends 39, 40 are arranged so that the largest working chamber formed between two adjacent vanes 13 is formed between them. In order to compress the air in this working chamber, the outer edge 29 of the leading vane 13 of these two vanes has still not yet made contact with end 40 of outlet slit 23 at the point that the inner edge of the trailing vane 13 is just opposite end 39 of inlet slit 18.

Even though a preferred embodiments of the invention has been illustrated and described herein, it is not intended to limit the invention and changes and modifications may be made therein within the scope of the following claims. For example, while the present embodiment describes single inlet and outlet slits in the housing, inlet and outlet slits can be machined in both the side wall of the cover section and in the side wall of the bell section. Further, these slits can also be formed to pass completely through the side wall of the cover section or bell section provided that the connecting suction or delivery channel is designed accordingly. Further, instead of four vanes, the pump may include five or more vanes pivotally mounted at circumferentially equispaced locations around the periphery of the rotor. Moreover, the outer and the inner edges of the vanes can also represent straight parallel lines with respect to each other.

While the pump is useful for compressible gases, it can also be designed for pumping an incompressible liquid in which case the flow medium is not compressed in the pump. For this purpose then, when the inner edge of the trailing vane is opposite the end of the inlet slit pointing in the direction of rotation, the outer edge of the leading vane of the largest working chamber formed in the pump must be in contact at least with the end of the outlet slit facing against the direction of rotation.

A rotary pump consists of a housing with a bore 7 and two side walls 17, each with an inlet and/or outlet slit 18, 23; a rotor support eccentrically in housing 1; and pivoting vanes attached around the periphery of the rotor. The free ends of these vanes slide with their free ends in the bore 7 and with their two side surfaces of the wide walls 17.

So that the rotary pump has a high degree of efficiency and also so that it can be produced economically, both the inlet slit(s) 18 and the outlet slit(s) 23 extend in each case along a circular, arc-shaped path around the rotational axis 15 of the rotor, so that the end 35 of the inlet slit(s) 18 facing against the direction of rotation of the rotor and the end 36 of the outlet slit(s) 23 pointing in the direction of rotation are near a central plane 34, which passes through the axis of the bore 7 of the housing and through the rotational axis 15 of the rotor (FIG. 3)

What is claimed is a:

1. A rotary pump comprising a housing having a bore and a bore axis, a first adjacent lateral side wall having at least one inlet slit and a second adjacent lateral side wall having at least one outlet slit of at least equal size to said inlet slit for flow of medium axially therethrough, said slits in said lateral side walls defining the path of flow for said medium from said inlet axially directly into said bore and then from said bore axially directly to said outlet slit, a rotor mounted in the bore for rotation about an axis generally parallel to and eccentric to the bore axis, a plurality of vanes pivotally mounted on the periphery of the rotor having free ends in sliding sealing contact with said bore, each vane having lateral surfaces facing the rotor and an outer edge facing the bore, said outer edge on rotation of the rotor passing over an inner boundary edge of the inlet and outlet slits facing the bore of the housing, said inlet slit and outlet, curing along an arc around the rotational axis of rotor and extending in such a way that the trailing end of the inlet slit and the leading end of the inlet slit are disposed adjacent a central plane passing through the axis of the bore of the housing and the rotational axis of the rotor, the inlet slit being disposed at a greater distance from the rotational axis of the rotor than the outlet slit and the length of the outlet slit being greater than that of the inlet slit.

2. Rotary pump according to claim 1, wherein the inner and the outer edges of the lateral surfaces of the vanes and the inner and the outer boundary edges of each inlet and outlet slit are approximately parallel to each other.

3. Rotary pump according to claim 1, wherein the distance of the inlet slit from the rotational axis of the rotor is about 1.2–1.4 times larger than the distance of the outlet slit from this rotational axis.

4. Rotary pump according to claim 1, wherein the length of the outlet slit is about 1.3–1.4 times as that of the inlet slit.

5. Rotary pump according to claim 1, wherein at least one of said slits is formed with a bottom surface and a connecting channel machined into this bottom surface, and wherein the depth of the bottom surface of the slit is at least 0.4 times as large as the distance between the inner and outer edges of the opposing lateral surface of each vane.

6. Rotary pump according to claim 5, characterized in that the cross section of the slit is at least half as large as the cross section of the connecting channel.

* * * * *